US009782983B2

(12) United States Patent
Hatanaka

(10) Patent No.: US 9,782,983 B2
(45) Date of Patent: Oct. 10, 2017

(54) INKJET RECORDING APPARATUS, INKJET RECORDING METHOD AND MEDIUM

(71) Applicant: Shinichi Hatanaka, Tokyo (JP)

(72) Inventor: Shinichi Hatanaka, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/709,405

(22) Filed: May 11, 2015

(65) Prior Publication Data

US 2015/0328908 A1 Nov. 19, 2015

(30) Foreign Application Priority Data

May 16, 2014 (JP) ..... 2014-102092

(51) Int. Cl.

| | |
|---|---|
| ***B41J 2/01*** | (2006.01) |
| ***B41J 11/00*** | (2006.01) |
| ***B41J 13/00*** | (2006.01) |
| ***B41J 2/195*** | (2006.01) |

(52) U.S. Cl.

CPC ..... *B41J 11/002* (2013.01); *B41J 2/195* (2013.01); *B41J 13/0009* (2013.01)

(58) Field of Classification Search

USPC ..... 347/101, 102, 9

See application file for complete search history.

(56) References Cited

U.S. PATENT DOCUMENTS

| | | | | |
|---|---|---|---|---|
| 8,240,837 | B2 * | 8/2012 | Usuda | B41J 2/2114 347/101 |
| 2005/0219287 | A1 * | 10/2005 | Tatsumi | B41J 2/145 347/9 |
| 2006/0013970 | A1 * | 1/2006 | Wada | H05K 3/28 428/32.24 |

FOREIGN PATENT DOCUMENTS

| | | |
|---|---|---|
| JP | 2013-086447 | 5/2013 |

* cited by examiner

*Primary Examiner* — Lam Nguyen

(74) *Attorney, Agent, or Firm* — Duft Bornsen & Fettig LLP

(57) ABSTRACT

An inkjet recording apparatus for curing ink ejected onto a base material and forming recorded matter on the base material is provided. The inkjet recording apparatus includes an ejection unit configured to eject the ink onto a first area of the base material and a second area surrounded by the first area, a curing unit configured to cure the ink ejected onto the base material, and a control unit configured to control the curing unit in such a way that a time from ink ejection onto the first area to ink curing is longer than a time from ink ejection onto the second area to ink curing.

6 Claims, 8 Drawing Sheets

FIG.3
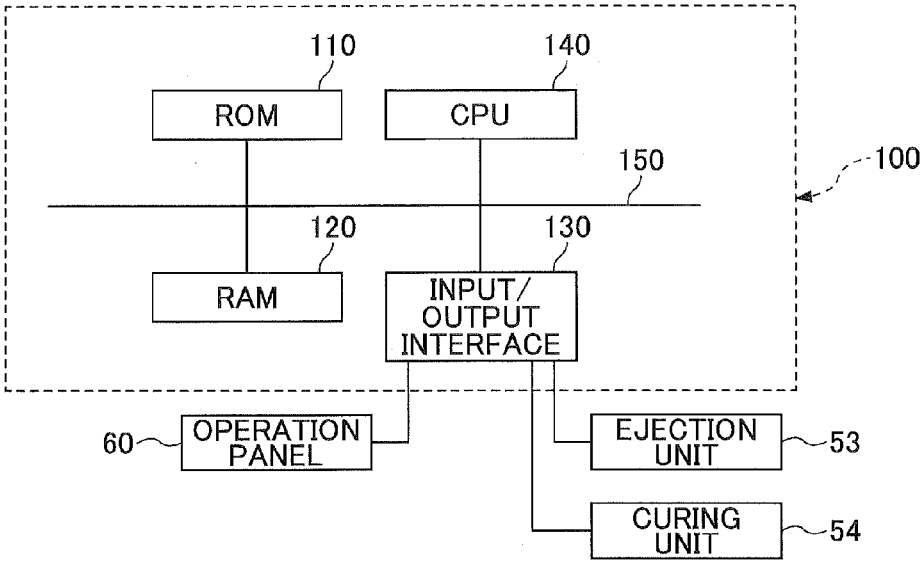
FIG.4
| | | BASE MATERIAL | | | |
|---|---|---|---|---|---|
| | | A | B | C | ··· |
| INK MATERIAL | a | TIME 1 | TIME 2 | TIME 3 | ··· |
| | b | ··· | | | |
| | c | | | | |
| | ⋮ | | | | |
41
FIG.5
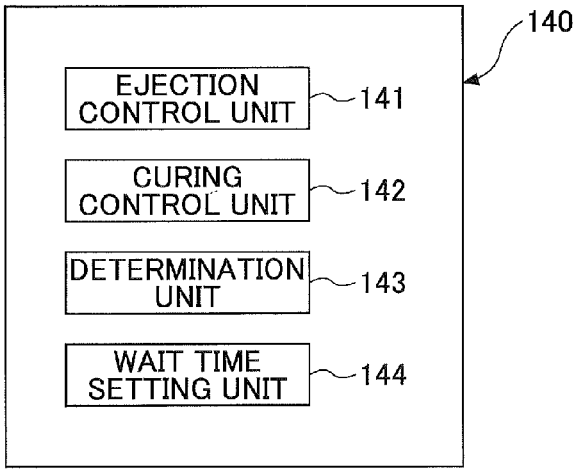

INKJET RECORDING APPARATUS, INKJET RECORDING METHOD AND MEDIUM

CROSS-REFERENCE TO RELATED APPLICATIONS

The present application is based on and claims the benefit of priority under 35 U.S.C. §119 of Japanese Patent Application No. 2014-102092 filed May 16, 2014, the entire contents of which are hereby incorporated herein by reference.

BACKGROUND OF THE INVENTION

1. Field of the Invention

The present invention generally relates to an inkjet recording apparatus, an inkjet recording method and a medium.

2. Description of the Related Art

Conventionally, as one of inkjet methods for forming recorded matter by ejecting ink onto a base material and then drying or curing the ink, a method is known in which, for example, a base image is formed on the base material (recording medium) and then a pattern image is formed on the base image. With this method, it is known that when the pattern image is formed on the base image, the ink which serves as a material of the pattern image may spread out wetting in an area other than the base image, which leads to deterioration of the image quality.

Therefore, conventionally, the spreading out wetting of the pattern image is suppressed by, after forming a raised portion by curing ink spread in a contour part of the image formed on the base material, spreading and curing ink in an area surrounded by the raised portion (e.g., refer to Patent Document 1).

However, in the conventional method described above, an occurrence of streaky unevenness of a raised portion and an un-raised portion in the surface of the recorded matter due to a misdirected ink ejection, a non-ink-ejection, or the like, is not considered. As a result, the surface of the recorded matter may not become smooth in the case where there has been a misdirected ink ejection, a non-ink-ejection, or the like.

[Patent Document 1] Japanese Laid-Open Patent Application No. 2013-086447

SUMMARY OF THE INVENTION

In an embodiment, an inkjet recording apparatus for curing ink ejected onto a base material and forming recorded matter on the base material is provided. The inkjet recording apparatus includes an ejection unit configured to eject ink onto a first area of the base material and a second area surrounded by the first area, a curing unit configured to cure the ink ejected onto the base material, and a control unit configured to control the curing unit in such a way that a time from an ejection of the ink onto the second area to an end of the curing is longer than a time from an ejection of the ink onto the first area to an end of the curing.

According to an embodiment, the surface of the recorded matter can be made smooth.

BRIEF DESCRIPTION OF THE DRAWINGS

FIG. 3 is a block diagram illustrating an example of a hardware structure of the inkjet recording apparatus according to the first embodiment.

FIG. 4 is a drawing illustrating a process condition table stored in a memory unit.

FIG. 5 is a drawing illustrating an example of a functional structure of a CPU of the inkjet recording apparatus according to the first embodiment.

DESCRIPTION OF THE PREFERRED EMBODIMENTS

Figure 1:
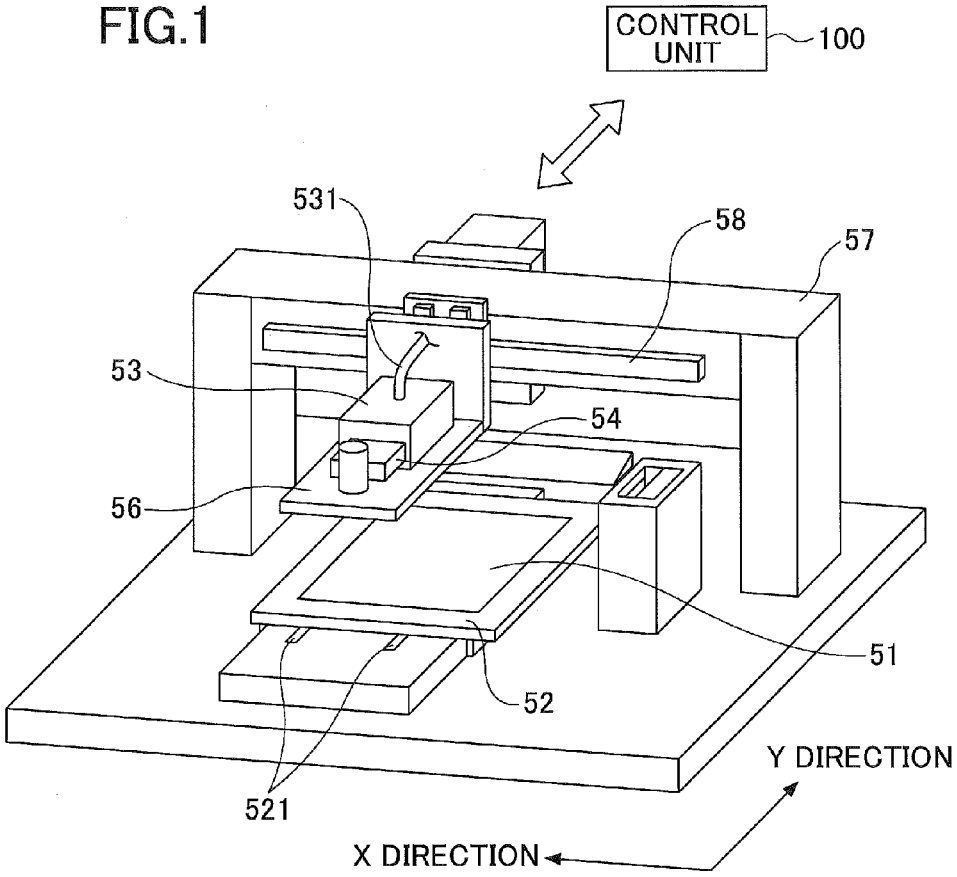
FIG. 1 is a drawing illustrating a schematic structure of an inkjet recording apparatus according to a first embodiment.

The inkjet recording apparatus according to the first embodiment forms recorded matter on a base material 51 by, after ejecting ink onto the base material 51 (hereinafter, referred to as "recording"), curing the ink, and has a structure, for example, as shown in FIG. 1.

The inkjet recording apparatus includes, as shown in FIG. 1, a stage 52 capable of driving the placed base material 51 in Y direction. Also, a head base 56 including an ejection unit 53 and a curing unit 54 is arranged to face the base material 51 placed on the stage 52.

The base material 51 is not particularly limited, and, for example, a film, a paper, glass, or metal can be used as the base material 51. As a film, for example, polyethylene (PE), polyvinyl chloride (PVC), polyvinyl alcohol (PVA), polypropylene (PP), polycarbonate (PC), or polyethylene terephthalate (PET) can be used.

The stage 52 is a stage on which the base material 51 is placed. A pair of guide rails 521 are arranged in the underside of the stage 52. Also, the stage 52 is arranged to be movable along the guide rails 521 in Y direction.

The ejection unit 53 is connected to an ink material supply pipe 531, configured to have ink supplied from a tank (not shown in the figure) in which the ink is stored, and capable of supplying the ink to the base material 51.

Figure 2:
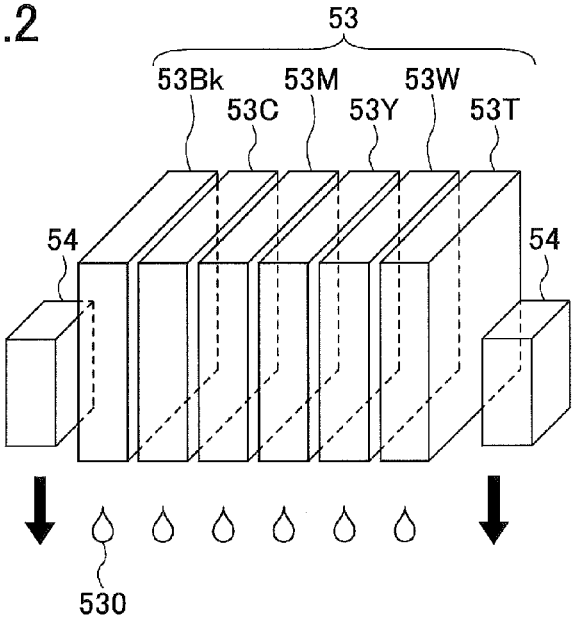
FIG. 2 is a drawing illustrating a schematic structure of a head portion of the inkjet recording apparatus according to the first embodiment.

Also, the ejection unit 53 includes, as shown in FIG. 2, six ejection parts, for example, a black (Bk) 53Bk, a cyan (C) 53C, a magenta (M) 53M, a yellow (Y) 53Y, a white (W) 53W, a transparent (T) 53T, and ejects each color of ink drops 530 onto the base material 51. Each of the ejection parts is installed in a head base 56 with its ink ejection direction being down.

As an ink material, a light curing type ink can be used and preferably, an ultraviolet curing type ink such as acrylic resin, epoxy resin, silicon-based resin, or the like, can be used.

The curing unit 54 cures ink by emitting light to the ink ejected onto the base material 51. The curing units 54 are arranged, for example, as shown in FIG. 2, near respective ends of the ejection unit 53 which includes an array of colors of ejection parts. Each of the curing units 54 is installed in the head base 56 with its light emitting direction being down as shown in the figure by arrows.

It should be noted that the number of curing units 54 is not particularly limited, and may be, for example, one or more. Also, an installation position of the curing units 54 is not particularly limited, and, for example, the curing units 54 may be installed in a independently drivable position independent from the ejection unit 53.

Also, the curing unit 54 is configured according to the ink material, and for example, in the case where the ultraviolet curing type ink is used, an ultraviolet light source which is capable of emitting ultraviolet light can be preferably used. As an ultraviolet light source, for example, an LED, a high-pressure mercury lamp, or a metal halide lamp may be used.

The head base 56 can be moved in X direction in the figure by an X axis drive unit 58 which is arranged in an X axis supporting member 57. As a result, by using the stage 52 and the X axis drive unit 58, a landing position of an ink drop ejected by the ejection unit 53 and a light emission position by the curing unit 54 can be changed to any position of the base material 51.

It should be noted that the structure of the inkjet recording apparatus according to the first embodiment may be any structure as long as the structure allows the stage 52 and the head base 56 to move relatively. For example, the inkjet recording apparatus may be configured to drive both the stage 52 and the head base 56 in X direction and Y direction in the figure, or may be configured to drive the stage 52 or the head base 56 in X direction and Y direction.

Also, the inkjet recording apparatus includes a control unit 100 for controlling the units described above.

The control unit 100 of the first embodiment controls the curing unit 54 in such a way that, assuming a contour portion of a layer formed on the base material 51 as the first area and assuming an inside of the contour portion as the second area, a time from ink ejection onto the second area to the start of ink curing is longer than a time from ink ejection onto the first area to the start of ink curing. It should be noted that the details of the first area and the second area will be described later.

In the following, referring to FIG. 3, a configuration of the control unit 100 will be described. FIG. 3 is a block diagram illustrating an example of a hardware structure of the inkjet recording apparatus according to the first embodiment.

The control unit 100 includes, as shown in FIG. 3, a ROM 110 and a RAM 120 as a memory unit, an input/output interface 130, a CPU 140 and a bus 150, and the ROM 110 and the RAM 120, the input/output interface 130 and the CPU 140 are connected to each other by the bus 150. Also, to the input/output interface 130 of the control unit 100, the ejection unit 53, the curing unit 54 and an operation panel 60 are connected.

The ROM 110 or the RAM 120 is the memory unit which stores a control program for causing the CPU 140 to perform processes of the inkjet recording apparatus and data such as process conditions used for forming the recorded matter.

The recorded matter is not particularly limited, and may include, for example, two dimensional (planar structure) recorded matter consisting of only one layer, three dimensional (3D) recorded matter in which layers are laminated, or the like.

The process conditions are stored as, for example, a process condition table 41 shown in FIG. 4, in the ROM 110 or the RAM 120. FIG. 4 is a drawing illustrating the process condition table 41 stored in the ROM 110 or the RAM 120.

In the process condition table 41 of the first embodiment, a type of ink material is associated with a predefined time set for each type of the base material 51. Here, the predefined time corresponds to a wait time which will be described later.

In the process condition table 41, it is preferable that a wait time set for each type of the base material 51 is determined based on wet characteristics of the ink for the base material 51. Specifically, in the case where the type of the base material 41 is "B" and the type of the ink material is "a", the wait time is "TIME 2".

In the first embodiment, the wait time is determined, for example, based on a preliminary experiment. As a preliminary experiment, there are, for example, a method in which the wait time is determined according to a contact angle of the ink with respect to the base material 51 when the ink is ejected onto the base material 51, and a method in which time needed is measured for ink drops ejected onto locations separated from each other with a predefined space (distance) to spread out to cover a predefined range.

It should be noted that the process condition is not limited to the process condition table 41 described above, and, for example, various condition tables may be predetermined based on the preliminary experiments, or the like, and may be stored in the ROM 110 or the RAM 120.

The input/output interface 130 outputs control signals output by the CPU 140 to the ejection unit 53, the curing unit 54, or the like. Also, the input/output interface 130 supplies a signal input from the operation panel 60 to the CPU 140.

The operation panel 60 is used for inputting and displaying information necessary for the inkjet recording apparatus The CPU 140 controls, for example, according to the control program stored in the ROM 110 or the RAM 120, operations of the inkjet recording apparatus. Also, the CPU 140, in response to an instruction from the operation panel 60, controls the inkjet recording apparatus according to the data for forming the recorded matter stored in the ROM 110 or the RAM 120.

The bus 150 is used for transferring information among the ROM 110, the RAM 120, the input/output interface 130, the CPU 140, and the like.

Also, a storage medium (not shown in the figure) is connected via the input/output interface 130. And, in the storage medium, a predetermined program is stored. The program stored in the storage medium is installed in the inkjet recording apparatus via, for example, a storage medium reading device, a network, or the like. As a result, the installed predetermined program becomes available for execution by the inkjet recording apparatus.

The storage medium is not particularly limited, and, a computer readable storage medium such as, for example, a magnetic disk, an optical disk, a flash memory, or the like may be included as the storage medium.

In the following, referring to FIG. 5, a functional structure of the CPU 140 will be described. FIG. 5 is a drawing illustrating an example of the functional structure of the CPU 140 of the inkjet recording apparatus according to the first embodiment.

As shown in FIG. 5, the CPU 140 includes an ejection control unit 141, a curing control unit 142, a determination unit 143, and a wait time setting unit 144. In the following, each unit will be described.

The ejection control unit 141 controls operations of the ejection unit 53 by reading process conditions stored in the ROM 110 or the RAM 120, and, according to the process conditions, causing the ejection unit 53 to move to a predetermined position of the base material 51, changing the process conditions of the ejection unit 53, or the like.

The curing control unit 142 controls operations of the curing unit 54 by reading process conditions stored in the ROM 110 or the RAM 120, and, according to the process conditions, causing the curing unit 54 to move to a predetermined position of the base material 51, changing the process conditions of the curing unit 54, or the like.

The determination unit 143 reads the process conditions stored in the ROM 110 or the RAM 120, and, according to the process conditions, determines whether various processes are completed, including, for example, determining whether a process by the ejection unit 53 or the curing unit 54 is completed or not.

The wait time setting unit 144, referring to the process condition table 41, sets a wait time from the completion of ink ejection onto the second area to the start of curing.

Next, processes of the CPU 140 in the control unit 100 of the inkjet recording apparatus according to the first embodiment will be described.

Figure 6:
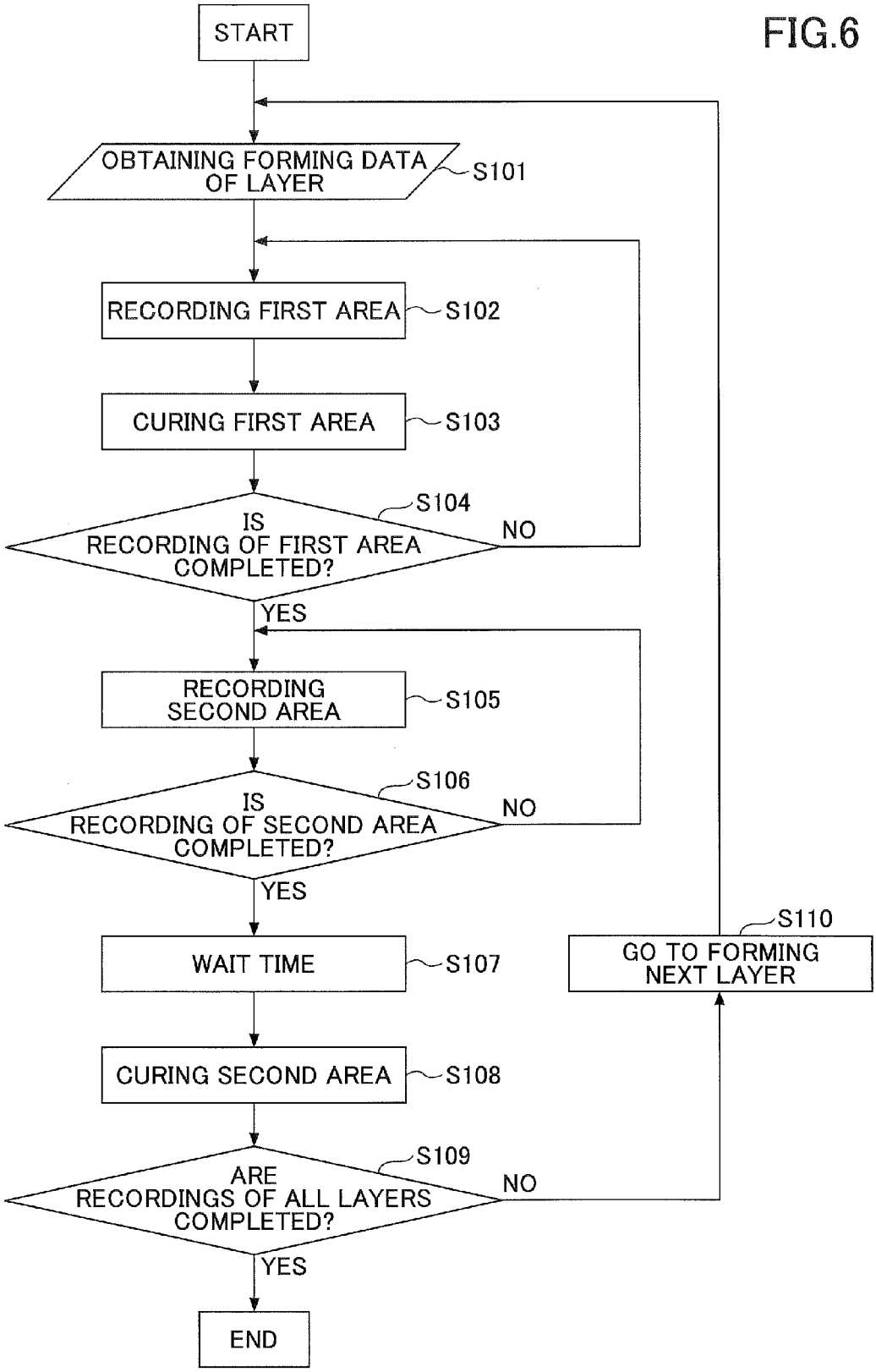
FIG. 6 is a flowchart describing a process of the CPU according to the first embodiment.

FIG. 6 is a flowchart describing the processes of the CPU 140 according to the first embodiment.

In the control unit 100 of the first embodiment, the CPU 140 obtains forming data of the first layer from the forming data of the recorded matter stored in the ROM 110 or the RAM 120 (step S101). It should be noted that the forming data of the recorded matter may be stored in advance in the ROM 110 or the RAM 120, or may be stored in the RAM 120 by being input by an operator via the operation panel 60.

Subsequently, the CPU 140, by using the ejection control unit 141, controls operations of the ejection unit 53 via the input/output interface 130 so that the corresponding ink is ejected onto the first area in a layer formed on the base material 51 (step S102).

Subsequently, the CPU 140, by using the curing control unit 142, controls operations of the curing unit 54 via the input/output interface 130 so that the light is emitted to the ink ejected onto the first area (step S103).

Next, the CPU 140, by using the determination unit 143, determines whether the ejection of the ink onto the first area and the curing are completed (step S104).

In step S104, in the case where the ejection of the ink for the first area and the curing are not completed (NO), the CPU 140 returns to step S102. In step S104, in the case where the ejection of the ink for the first area and the curing are completed (YES), the CPU 140, by using the ejection control unit 141, controls operations of the ejection unit 53 via the input/output interface 130 so that the corresponding ink is ejected onto the second area in the layer formed on the base material 51 (step S105).

Next, the CPU 140, by using the determination unit 143, determines whether the ejection of the ink onto the second area is completed (step S106).

In step S106, in the case where the ejection of the ink onto the second area is not completed (NO), the CPU 140 returns to step S105. In step S106, in the case where the ejection of the ink onto the second area is completed (YES), the CPU 140, by using the wait time setting unit 144, referring to the process condition table 41, sets the wait time for starting the curing of the ink ejected onto the second area (step S107).

More specifically, the wait time setting unit 144, at this time, obtains information indicating a type of ink ejected onto the second area and information indicating a type of the base material 51. Then, the wait time setting unit 144, based on the obtained information, sets the time corresponding to the matching condition in the process condition table 41 as a wait time for the curing control unit 142.

Subsequently, the CPU 140, by using the curing control unit 142, controls operations of the curing unit 54 via the input/output interface 130 so that the light is emitted to the ink ejected onto the second area of the base material 51 after the set wait time has elapsed (step S108).

The CPU, by using the determination unit 143, determines whether the desired number of layers are formed on the base material 51 (step S109). In step S109, in the case where the desired number of layers are formed (YES), the process is finished. In step S109, in the case where the desired number of layers are not formed (NO), the CPU 140 reads the next layer of the forming data (step S110) and returns to step S101.

In the following, referring to FIG. 7, operations of the control unit 100 of the inkjet recording apparatus according to the first embodiment will be described more specifically.

Figure 7:
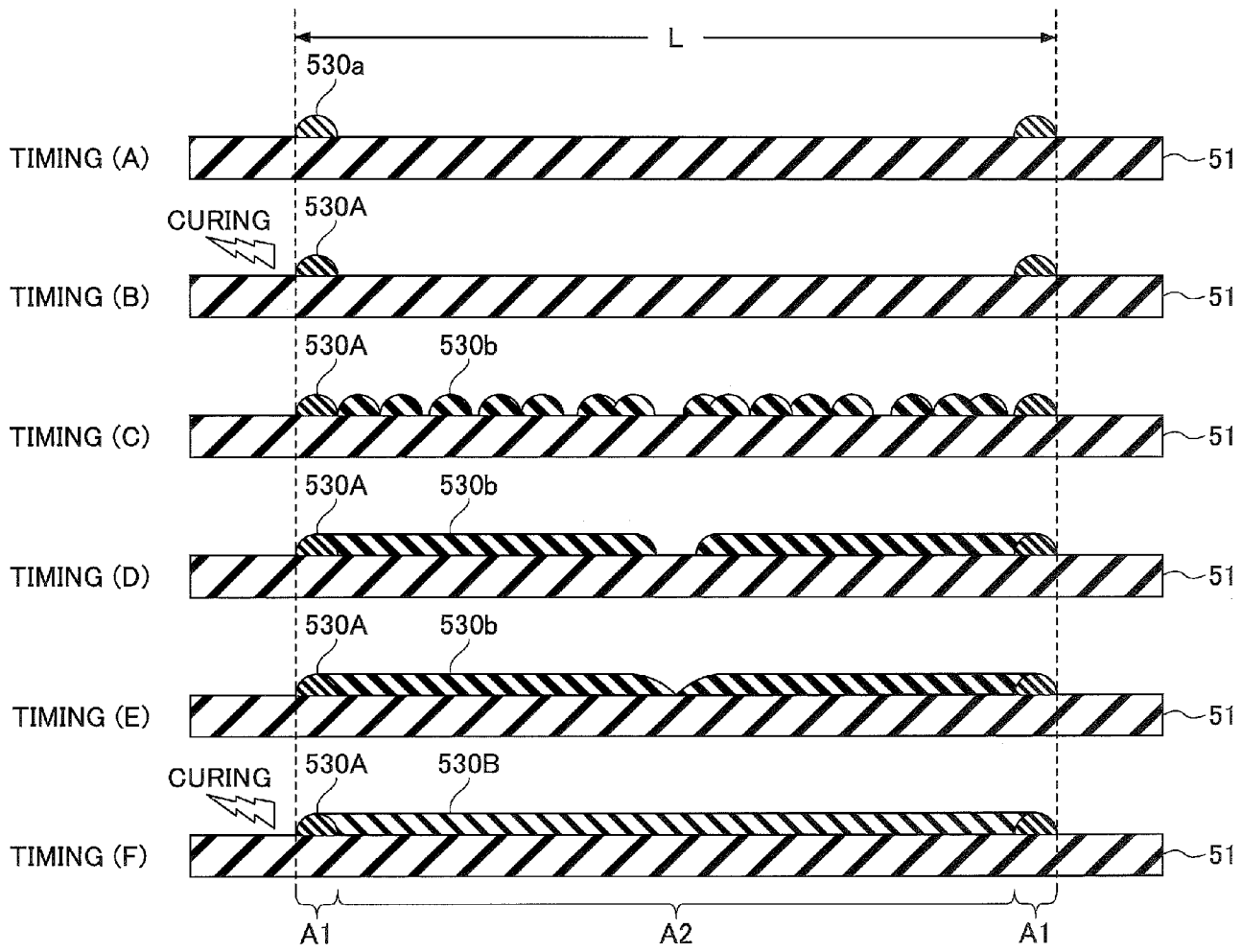
FIG. 7 is an explanatory drawing illustrating an inkjet recording method according to the first embodiment.

In FIG. 7, it is assumed that the first area is A1, the ink ejected onto the first area A1 is ink 530*a*. Also, In FIG. 7, it is assumed that the second area is A2, the ink ejected onto the second area A2 is ink 530*b*.

First, as shown in FIG. 7 at timing (A), the ejection unit 53 ejects the ink 530*a* onto the first area A1 of the base material 51. Here, the first area A1 represents a contour portion which is a peripheral area within a length L in which the recorded matter should be formed. Then, as shown in FIG. 7 at timing (B), the curing unit 54 cures the ink 530*a* by emitting light of predetermined strength to the ink 530*a* which has been ejected onto the first area A1 of the base material 51. With this curing, a layer 530A is formed by the cured ink 530*a* in the first area A1 of the base material 51.

Next, as shown in FIG. 7, at timing (C), the ejection unit 53 ejects the ink 530*b* onto the second area A2 of the base material 51, which is surrounded by the first area A1. At this time, the CPU 140, by using the curing control unit 142, sets the wait time before the start of curing the ink 530*b* from the ejection of the ink 530*b* onto the second area A2. As a result, in the first embodiment, a curing process by the curing unit 54 does not start immediately after the ejection of the ink 530*b* onto the second area A2. In other words, a time from the ejection of the ink 530*b* onto the second area A2 to the start of curing the ink 530*b* is longer than a time from the ejection of the ink 530*a* onto the first area A1 to the start of curing the ink 530*a*.

Also, the ink 530*b* ejected onto the second area A2 of the base material 51, with the lapse of time, as shown in FIG. 7, at timing (D) and at timing (E), spreads out wetting the surface of the second area A2 of the base material 51. Also, because the second area A2 of the base material 51 is surrounded by the first area A1, the ink 530*b* ejected onto the second area A2 of the base material 51 does not spread out beyond the length L in which the recorded matter should be formed.

Then, as shown in FIG. 7, at timing (F), the curing unit 54 cures the ink 530*b* by emitting light of predetermined strength to the ink 530*b* which has been ejected onto the second area A2 of the base material 51. With this curing, a layer 530B is formed by the cured ink 530*b* in the second area A2 of the base material 51.

In the first embodiment, by setting the wait time as described above, the ink 530*b* spreads out wetting the second area A2 before the completion of curing the ink 530*b* in the second area A2, thereby the occurrence of streaky unevenness of a raised portion and an un-raised portion in the surface of the layer can be avoided and the surface of the layer can be made smooth.

Here, it is preferable that the CPU 140, by using the curing control unit 142, controls the curing unit 54 in such a way that the strength of the light emitted to the ink 530*b* ejected onto the second area A2 is controlled to be lower than the strength of the light emitted to the ink 530*a* ejected onto the first area A1. If the strength of the light emitted to the ink 530*b* is made lower, then the time required for completion of curing the ink 530*b* becomes further longer. As a result, the ink 530*b* spreads out wetting further in the second area A2, thereby the surface of the layer is made smoother.

As described above, in the first area A1 and the second area A2 of the base material 51, recorded matter including the layer 530A and the layer 530B with the desired length L is formed.

Next, an action effect by the inkjet recording apparatus according to the first embodiment will be described.

According to the inkjet recording apparatus of the first embodiment as described above, the CPU 140, by using the curing control unit 142, controls the curing unit 54 in such a way that a time from the ejection of the ink 530*b* onto the second area A2 to the start of curing the ink 530*b* is controlled to be longer than a time from the ejection of the ink 530*a* onto the first area A1 to the start of curing the ink 530*a*. As a result, although the ink 530*b* ejected onto the second area A2 of the base material 51 exists in a droplet state immediately after the ejection, as the time elapses, the ink 530*b* spreads out wetting the surface of the second area A2 of the base material 51.

As a result, even in the case where a groove is formed in the second area A2 due to, for example, the misdirected ejection of the ink, the non-ink-ejection, or the like, the groove can be filled with the ink and a layer with a smooth surface can be formed.

Especially in the case of forming recorded matter with a 3D structure in which layers are laminated, the layers to be formed are greatly affected by an unevenness of a raised portion and an un-raised portion of the foundation layer which has already been formed. However, according to the inkjet recording apparatus of the first embodiment, because the surface of each layer is formed smooth, another layer can be laminated on top of the smooth foundation layer. As a result, recorded matter with a smooth surface can be formed.

Next, in order to compare with an inkjet recording apparatus according to the first embodiment, a case will be described referring to FIG. 8, in which the control unit 100 of the first embodiment is not included in an inkjet recording apparatus. It should be noted that, in FIG. 8, the ink ejected onto the base material 51 is referred to ink 530*b*.

Figure 8:
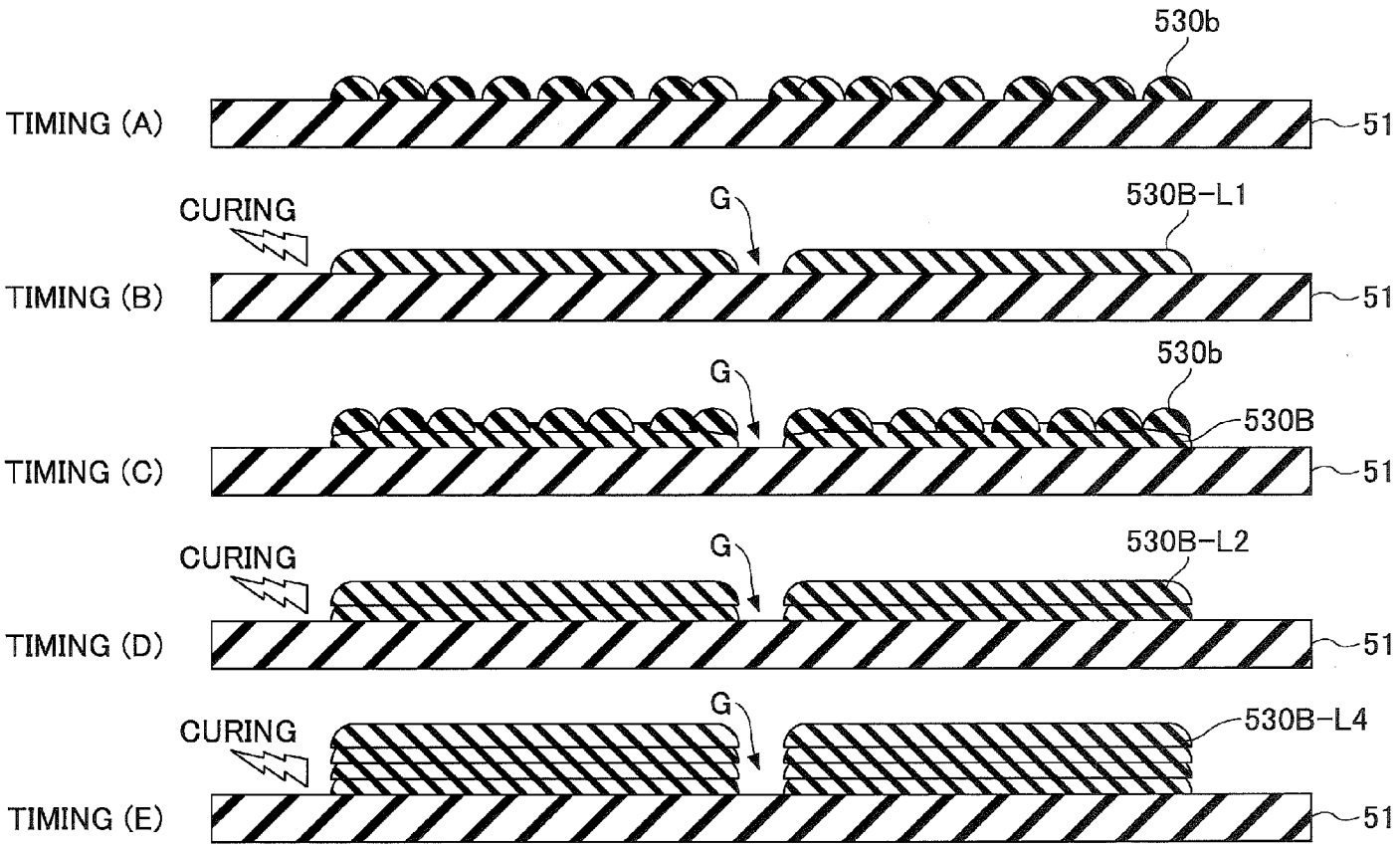
FIG. 8 is a drawing for describing an effect of the inkjet recording method according to the first embodiment.

FIG. 8 is a drawing illustrating processes for forming recorded matter by, after ejecting ink onto the base material 51, repeating curing processes, and laminating a plurality of layers on the base material 51.

When ink 530*b* is ejected onto the surface of the base material 51, positions of the droplets of the ink 530*b* may vary due to a misdirected ejection of the ink 530*b*, a non-ink-ejection, or the like, as shown in FIG. 8, at timing (A). And, when the positions of the droplets of the ink 530*b* varies, a groove may be formed in the second area A2.

In this case, if the ink 530*b* is cured by having light with a predetermined strength emitted to the ink 530*b* which has been ejected onto the base material 51, then, as shown in FIG. 8, at timing (B), a gap G between a layer 530B-L1 left and a layer 530B-L1 right may be created due to an influence of the ink 530*b* the positions of whose ejected droplets have had varied. In other words, an unevenness between a raised portion and a non-raised portion is created on the surface of the layer 530B-L1 by the raised portion in which a layer 530B-L1 is formed on the surface of the base material 51 and the non-raised portion (gap G) in which a layer 530B-L1 is not formed on the surface of the base material 51, exposing the base material 51.

Also, when ink 530*b* is ejected onto the surface of the formed layer 530B-L1 (foundation layer), as shown in FIG. 8, at timing (C), the ink 530*b* ejected onto the surface of the foundation layer is affected by the unevenness between the raised portion and the un-raised portion of the foundation layer. When the ink 530*b* is cured by having light with a predetermined strength emitted to the ink 530*b* which has been ejected onto the base material 51, as shown in FIG. 8, at timing (D), the unevenness between the raised portion and the un-raised portion of the surface of the formed layer 530B-L2 becomes larger.

Furthermore, when the ink 530*b* is ejected as before, and cured as before, as shown in FIG. 8 at timing (E), the unevenness of a raised portion and an un-raised portion of the surface of the layer 530B-L4 becomes further larger.

As described above, in the comparative example, a layer with a large unevenness between a raised portion and an un-raised portion is formed. Also, in the case of forming recorded matter with a 3D structure by laminating a plurality of layers, due to the big influence of the unevenness between a raised portion and an un-raised portion of the foundation layer, the unevenness between a raised portion and an un-raised portion gets larger.

As described above, the inkjet recording apparatus according to the first embodiment can reduce the unevenness between a raised portion and an un-raised portion of the surface of the layer of the recorded matter, thereby making the surface of the layer smooth.

Next, a program for forming recorded matter by an inkjet recording method according to the first embodiment will be described.

The program is, as described before, stored in a storage medium such as a magnetic disk, an optical disk, or a flash memory. By installing the program stored in the storage medium in a computer via, for example, a storage medium reading apparatus, a network, or the like, and by causing the computer to execute the program, processes of the inkjet recording method according to the first embodiment can be performed.

As described above, according to the inkjet recording apparatus, the inkjet recording method and the program of the first embodiment, an ejection unit 53 configured to eject ink onto the first area of the base material 51 and the second area which is surrounded by the first area, a curing unit 54 configured to cure the ink ejected onto the base material 51, and a control unit 100 configured to control the curing unit 54 in such a way that a time from the ejection of the ink onto the second area to the start of curing is longer than a time from the ejection of the ink onto the first area to the start of curing, are provided. As a result, the surface of the recorded matter can be made smooth.

Second Embodiment

Next, an inkjet recording apparatus, an inkjet recording method and a program according to the second embodiment of the present invention will be described.

The inkjet recording apparatus according to the second embodiment differs from the inkjet recording apparatus according to the first embodiment in that the ejection unit 53 includes a first ejection unit 53*a* configured to eject ink onto the first area of the base material 51 and a second ejection unit 53*b* configured to eject ink onto the second area of the base material 51.

With the above difference, according to the inkjet recording apparatus of the second embodiment, ink of different materials can be ejected onto the first area and the second area, respectively.

It should be noted that in the inkjet recording apparatus according to the second embodiment, the CPU 140 may or may not include the wait time setting unit 144.

It should be noted that the inkjet recording apparatus according to the second embodiment includes, other than the above difference, the same configuration as the first embodiment. Therefore, in the following description, points different from the first embodiment will be mainly described.

The ejection unit 53 includes the first ejection unit 53*a* configured to eject ink onto the first area of the base material 51 and the second ejection unit 53*b* configured to eject ink onto the second area of the base material 51. As a result, the ejection unit 53 is capable of ejecting inks of different materials onto the first area and the second area, respectively.

Determination of the material of ink ejected onto the first area and material of ink ejected onto the second area is made in such a way that the time required from the ejection of ink onto the second area to the end of curing (hereinafter also referred to "curing speed") is longer than the time required from the ejection of ink onto the first area to the end of curing.

As a determination method of the curing speed, it is preferable that the material of ink ejected onto the first area and the material of ink ejected onto the second area are selected in such a way that a sensitivity of the ink ejected onto the second area for the light emitted by the curing unit 54 is weaker than a sensitivity of the ink ejected onto the first area.

As a selection method of the ink material, it is preferable that the ink ejected onto the first area and the ink ejected onto the second area include an initiator, and that an amount of the initiator included in the ink ejected onto the second area is less than an amount of the initiator included in the ink ejected onto the first area. As an initiator, for example, a material in which 2,4,6-trimethylbenzoyl-diphenyl-phosphineoxide, 1-hydroxy-cyclohexyl-phenyl-ketone, and diethyl-thioxanthone are mixed can be preferably used.

Also, as a selection method of ink material, it is preferable that the ink ejected onto the first area and the ink ejected onto the second area include different initiators. Specifically, as an initiator used for the ink ejected onto the first area, for example, a material in which bis(2,4,6-trimethylbenzoyl)-phenylphosphine oxide, diethyl-thioxanthone and 1-hydroxy-cyclohexyl-phenyl-ketone are mixed can be preferably used. Also, as an initiator used for the ink ejected onto the second area, for example, a material in which 2,4,6-trimethylbenzoyl-diphenyl-phosphineoxide and 1-hydroxy-cyclohexyl-phenyl-ketone are mixed can be preferably used.

Next, a process of the CPU 140 in the control unit 100 of the inkjet recording apparatus according to the second embodiment will be described.

Figure 9:
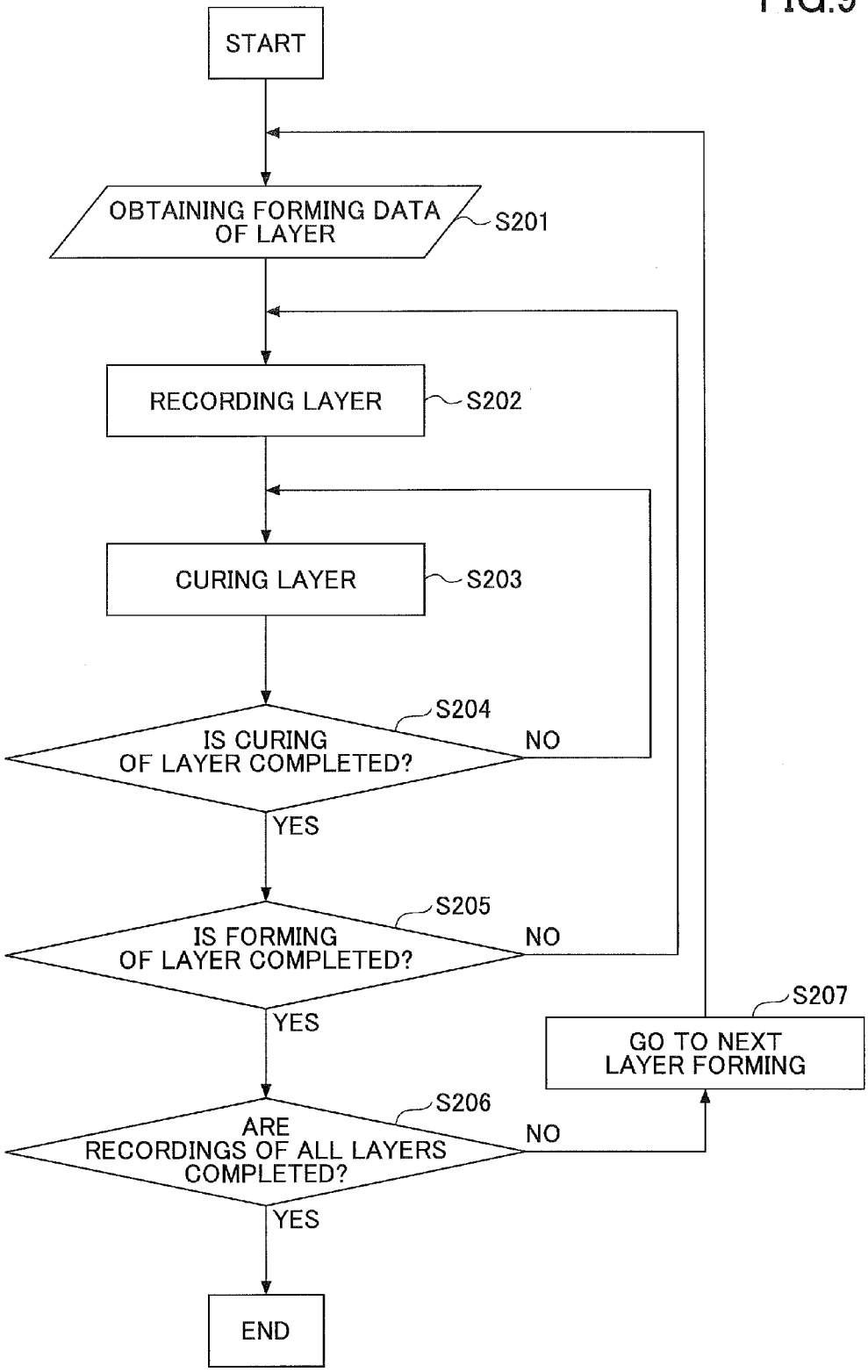
FIG. 9 is a flowchart describing a process of a CPU according to a second embodiment.

FIG. 9 is a flowchart illustrating a process of the CPU 140 according to the second embodiment.

In the control unit 100 of the second embodiment, the CPU 140 obtains forming data of the first layer from the forming data of the recorded matter stored in the ROM 110 or the RAM 120 (step S201). It should be noted that the forming data of the recorded matter may be stored in advance in the ROM 110 or the RAM 120, or may be stored in the RAM 120 by being input by an operator via the operation panel.

Subsequently, the CPU 140, by using the ejection control unit 141, controls operations of the first ejection unit 53*a* and the second ejection unit 53*b* via the input/output interface so that the corresponding inks are ejected onto the first area and the second area in a layer to be formed on the base material 51 (step S202).

Subsequently, the CPU 140, by using the curing control unit 142, controls operations of the curing unit 54 via the input/output interface so that the light is emitted to the ink which has been ejected onto the first area (step S203).

Next, the CPU 140, by using the determination unit 143, determines whether the curing of the ink ejected onto the base material 51 is completed (step S204).

In step S204, in the case where the curing of the ink ejected onto the base material 51 is not completed (NO), the CPU 140 returns to step S203. In step S204, in the case where the curing of the ink ejected onto the base material 51 is completed (YES), the CPU 140, by using the determination unit 143, determines whether the ejection and the curing of the ink (layer forming) for the base material 51 is completed (S205).

In step S205, in the case where the ejection and the curing of the ink for the base material 51 is not completed (NO), the CPU 140 returns to step S202. In step S205, in the case where the ejection and the curing of the ink for the base material 51 is completed (YES), the CPU 140, by using the determination unit 143, determines whether the desired number of layers have been formed in the base material 51 (S206).

In step S206, in the case where the desired number of layers have been formed in the base material 51 (YES), the process is ended. In step S206, in the case where the desired number of layers have not been formed in the base material 51 (NO), the CPU 140 reads the forming data of the next layer (step S207) and returns to step S201.

In the following, referring to FIG. 10, operations of the control unit 100 of the inkjet recording apparatus according to the second embodiment will be described more specifically.

Figure 10:
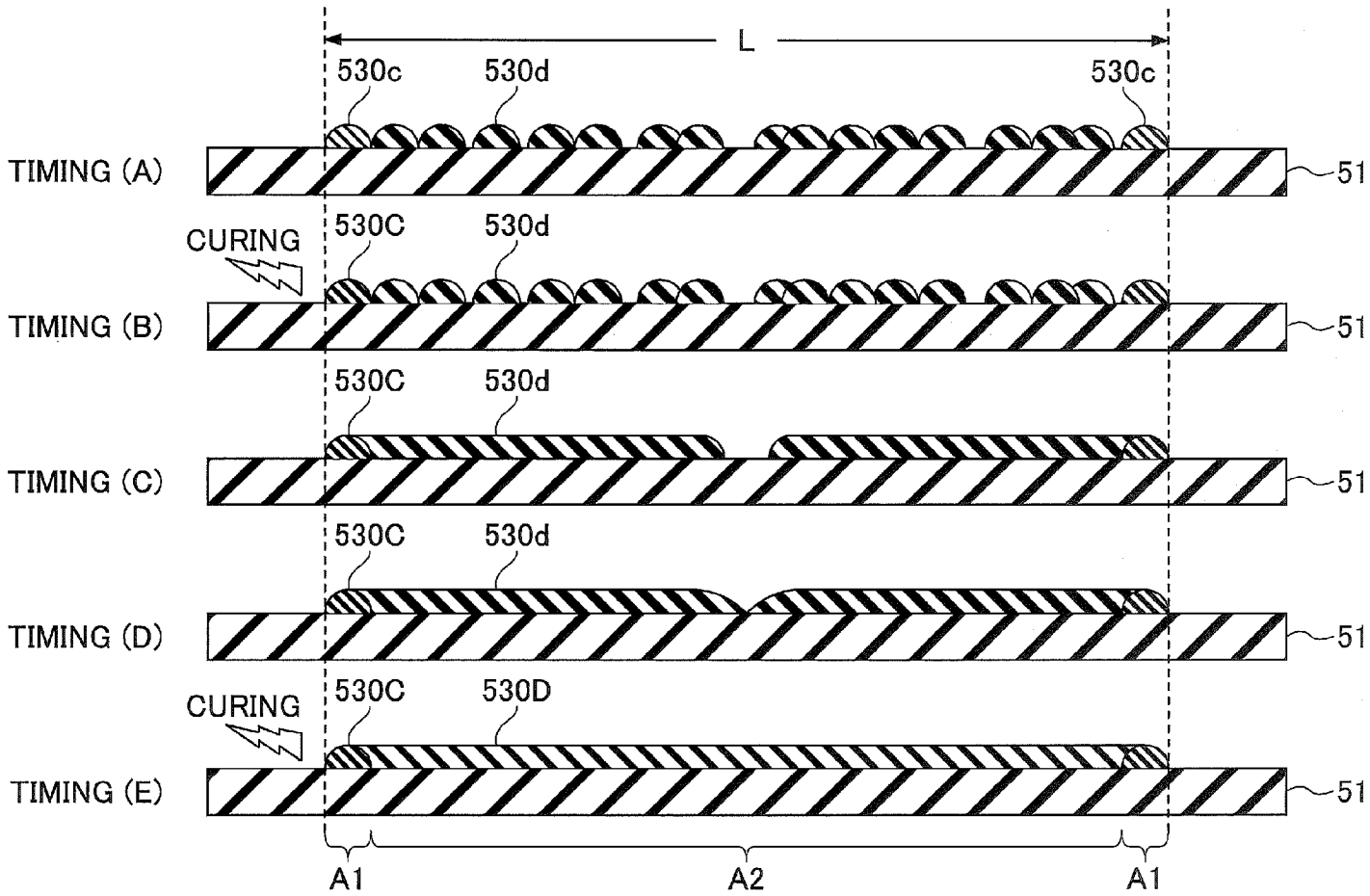
FIG. 10 is an explanatory drawing illustrating an inkjet recording method according to the second embodiment.

In FIG. 10, it is assumed that the first area is A1 and the ink ejected onto the first area A1 is ink 530*c*. Also, in FIG. 10, it is assumed that the second area is A2 and the ink ejected onto the second area A2 is ink 530*d*.

First, as shown in FIG. 10, at timing (A), the first ejection unit 53*a* ejects the ink 530*c* onto the first area A1 of the base material 51. Also, the ejection unit 53*b* ejects the ink 530*d* onto the second area A2 of the base material 51. Then, as shown in FIG. 10 at timing (B), the curing unit 54 cures the ink 530*c* and the ink 530*d* by emitting light of predetermined strength to the ink 530*c* and the ink 530*d* which have been ejected onto the base material 51.

At this time, it is set in such a way that the time required for the ink 530*d* ejected onto the second area A2 to the end of curing is longer than the time required for the ink 530*c* ejected onto the first area A1 to the end of curing. As a result, although the ink 530*c* ejected onto the first area A1 is sufficiently cured, forming a layer 530C, the ink 530*d* ejected onto the second area A2 is not sufficiently cured. Also, the ink 530*d* ejected onto the second area A2 of the base material 51, with the lapse of time, as shown in FIG. 10, at timing (C) and at timing (D), spreads out wetting the surface of the second area A2 of the base material 51.

Also, because the second area A2 of the base material 51 is surrounded by the first area A1, the ink 530*d* ejected onto the second area A2 of the base material 51 does not spread out wetting beyond the length L in which the recorded matter should be formed.

And, by repeating the curing by the curing unit 54, the ink 530*d* ejected onto the second area A2 is gradually cured. With the above processes, a layer 530D is formed from the cured ink 530*d* in the second area A2 of the base material 51.

In the second embodiment, as described above, the time required for the ink 530*d* from ejection onto the second area A2 to the end of curing is determined to be longer than the time required for the ink 530*c* from ejection onto the first area A1 to the end of curing. As a result, the ink 530*d* spreads out wetting the second area A2 before the completion of curing the ink 530*d*, thereby the occurrence of streaky unevenness of a raised portion and an un-raised portion in the surface of the layer can be avoided and the surface of the layer can be made smooth.

As described above, in the first area A1 and the second area A2 of the base material 51, recorded matter including the layer 530A and the layer 530B with the desired length is formed.

As described above, according to an inkjet recording apparatus, an inkjet recording method and a program of the second embodiment, the same action effect as the first embodiment can be achieved.

In particular, in the second embodiment, because it is possible to eject the ink onto the first area and the ink onto the second area at the same timing, the number of processes for forming the recorded matter can be reduced and the processes can be simplified.

Third Embodiment

Next, an inkjet recording apparatus, an inkjet recording method and a program according to the third embodiment of the present invention will be described.

The inkjet recording apparatus according to the third embodiment differs from the inkjet recording apparatus according to the second embodiment in that the inkjet recording apparatus according to the third embodiment includes a temperature adjustment unit 59 configured to adjust temperature of at least one of the first ejection unit 53*a* and the second ejection unit 53*b*, and include a temperature control unit 145 for a CPU to control the temperature adjustment unit 59.

With the above difference, the inkjet recording apparatus according to the third embodiment can eject inks with different temperatures to the first area and the second area, respectively.

It should be noted that the inkjet recording apparatus according to the third embodiment includes, other than the above difference, the same configuration as the second embodiment. Therefore, in the following description, points different from the second embodiment will be mainly described.

The temperature adjustment unit 59 adjusts the temperature of at least one of the ink ejected onto the first area and the ink ejected onto the second area. The temperature adjustment unit 59 is attached to the ejection unit 53 which ejects ink, a tank in which the ink is stored, or the like. The temperature adjustment unit 59 is not particularly limited, and, for example, a temperature adjustment apparatus such as a heater unit or a chiller unit which is capable of maintaining temperature of the ink at a predefined temperature is included as the temperature adjustment unit 59.

Figure 11:
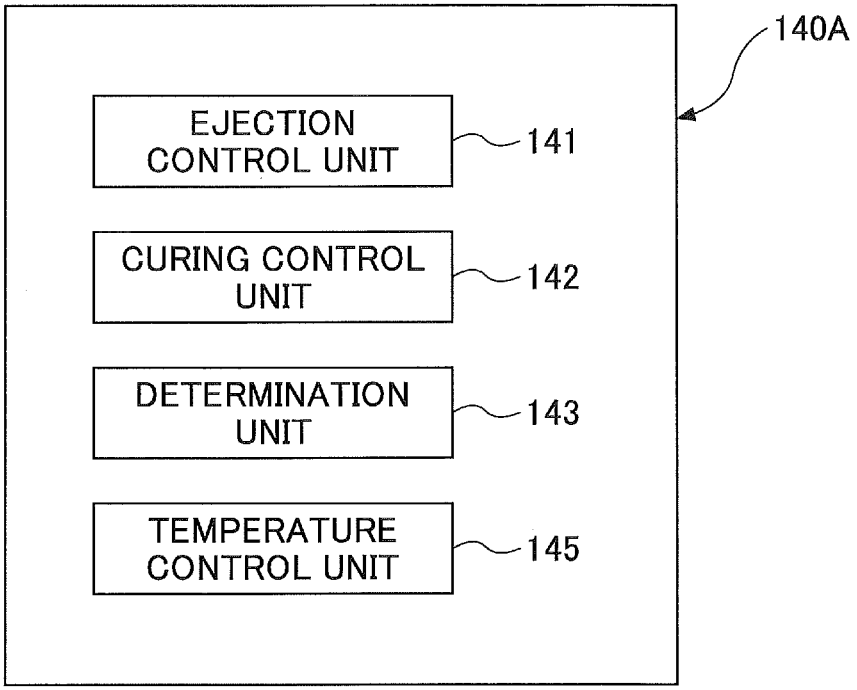
FIG. 11 is a drawing illustrating an example of a functional structure of a CPU of an inkjet recording apparatus according to a third embodiment.

Next, referring to FIG. 11, a functional structure of the CPU according to the third embodiment will be described. FIG. 11 is a drawing illustrating an example of the functional structure of a CPU 140A of the inkjet recording apparatus according to the third embodiment.

As shown in FIG. 11, the CPU 140A includes the ejection control unit 141, the curing control unit 142, the determination unit 143, and the temperature control unit 145.

The temperature control unit 145 reads process conditions stored in the ROM 110 or the RAM 120, and, according to the process conditions, controls operations of the temperature adjustment unit 59 including raising or lowering the temperature of the temperature adjustment unit 59.

Specifically, the temperature control unit 145 controls the operations of the temperature adjustment unit 59 in such a way that the temperature of the ink ejected onto the second area is higher than the temperature of the ink ejected onto the first area. With the above operations, a viscosity of the ink ejected onto the second area becomes lower than a viscosity of the ink ejected onto the first area, and, as a result, the ink ejected onto the second area spreads out wetting the surface of the base material 51 faster than the ink ejected onto the first area.

It should be noted that the process condition is, as a process condition table (not shown), stored in the ROM 110 or the RAM 120. Also, in the process condition table of the third embodiment, types of the ink materials are associated with temperatures set for each type of the base material 51.

In the third embodiment, as described above, by having inks of different temperatures ejected onto the first area and the second area, respectively, the ink ejected onto the second area spreads out wetting faster than the ink ejected onto the first area during the time the ink is cured by the curing unit 54. As a result, the occurrence of streaky unevenness of a raised portion and an un-raised portion in the surface of the layer can be avoided and the surface of the layer can be made smooth.

As described above, according to an inkjet recording apparatus, an inkjet recording method and a program of the third embodiment, the same action effect as the second embodiment can be achieved.

In particular, in the third embodiment, because it is possible to eject the ink of the same material onto the first area and the second area, the step of determining whether the curing of the layer is completed, as described in the second embodiment (step S203 in FIG. 9) can be omitted. As a result, the number of processes for forming the recorded matter can be reduced and the processes can be further simplified.

As described above, although the inkjet recording apparatuses, the inkjet recording methods and the programs have been described referring to the embodiments, the present invention is not limited to the above embodiments and various modifications and variations can be made within the scope of the present invention.

The present application is based on and claims the benefit of priority of Japanese Priority Application No. 2014-102092 filed on May 16, 2014 with the Japanese Patent Office, the entire contents of which are hereby incorporated by reference.

What is claimed is:

1. An inkjet recording apparatus for, by curing ink ejected onto a base material, forming recorded matter on the base material, the inkjet recording apparatus comprising:

an ejection unit configured to eject ink onto the base material;

a curing unit configured to cure ink ejected onto the base material;

a control unit configured to direct the ejection unit to eject ink onto a first area of the base material, to control the curing unit to cure ink ejected onto the first area, to direct the ejection unit to eject ink onto a second area of the base material in response to curing ink ejected onto the first area, wherein the second area is surrounded by the first area and ink ejected onto the second area is prevented from leaving the second area by the cured ink of the first area, and to control the curing unit to cure ink ejected onto the second area; and a memory unit configured to store a predetermined time determined based on wet characteristics of the ink for the base material, wherein the control unit is further configured to, after the predetermined time elapses from the ejection of the ink onto the second area, cause the curing unit to start curing the ink ejected onto the second area.

2. The inkjet recording apparatus according to claim 1, wherein the curing unit is further configured to cure the ink by emitting light to the ink, and the control unit is further configured to control the curing unit in such a way that strength of light emitted to the ink ejected onto the second area is weaker than strength of light emitted to the ink ejected onto the first area.

3. The inkjet recording apparatus according to claim 1, wherein the curing unit is further configured to cure the ink by emitting light to the ink, and wherein sensitivity for the light of the ink ejected onto the second area is weaker than sensitivity for the light of the ink ejected onto the first area.

4. The inkjet recording apparatus according to claim 1, wherein the ejection unit is further configured to include a first ejection unit for ejecting the ink onto the first area and a second ejection unit for ejecting the ink onto the second area, wherein the inkjet recording apparatus further includes a temperature adjustment unit configured to adjust temperature of at least one of the ink ejected by the first ejection unit and the ink ejected by the second ejection unit, wherein the control unit is further configured to control the temperature adjustment unit in such a way that temperature of the ink ejected by the second ejection unit is higher than temperature of the ink ejected by the first ejection unit.

5. An inkjet recording method for an inkjet recording apparatus including an ejection unit for ejecting ink onto a base material and a curing unit for curing the ejected ink, the inkjet recording method comprising:

ejecting, by the ejection unit, ink onto a first area of the base material;

curing, by the curing unit, ink ejected onto the first area;

ejecting, by the ejection unit, ink onto a second area of the base material in response to curing ink ejected onto the first area, wherein the second area is surrounded by the first area and ink ejected onto the second area is prevented from leaving the second area by the cured ink of the first area;

storing a predetermined time determined based on wet characteristics of the ink for the base material;

after the predetermined time elapses from the ejection of the ink onto the second area, causing the curing unit to start curing the ink ejected onto the second area; and curing, by the curing unit, ink ejected onto the second area.

6. A computer-readable recording medium having a program embodied therein for causing an inkjet recording apparatus including an ejection unit for ejecting ink onto a base material and a curing unit for curing the ejected ink to execute a method comprising:

ejecting, by the ejection unit, ink onto a first area of the base material;

curing, by the curing unit, ink ejected onto the first area;

ejecting, by the ejection unit, ink onto a second area of the base material in response to curing ink ejected onto the first area, wherein the second area is surrounded by the first area and ink ejected onto the second area is prevented from leaving the second area by the cured ink of the first area;

storing a predetermined time determined based on wet characteristics of the ink for the base material;

after the predetermined time elapses from the ejection of the ink onto the second area, causing the curing unit to start curing the ink ejected onto the second area; and curing, by the curing unit, ink ejected onto the second area.

* * * * *